United States Patent [19]

Aoki et al.

[11] Patent Number: 4,558,572

[45] Date of Patent: Dec. 17, 1985

[54] CONTACT FREEZING APPARATUS

[75] Inventors: Shigetada Aoki, Chofu; Masahiko Usui, Tokyo; Kojuro Kitano, Chiba, all of Japan

[73] Assignees: Taiyo Fishery Co., Ltd.; Mayekawa Mfg. Co., Ltd., both of Tokyo, Japan

[21] Appl. No.: 606,502

[22] Filed: May 3, 1984

[30] Foreign Application Priority Data

May 4, 1983 [JP] Japan ..... 58-77397

[51] Int. Cl.[4] ..... F25D 25/00

[52] U.S. Cl. ..... 62/378

[58] Field of Search ..... 62/250, 258, 336, 374, 62/237, 345, 377, 378, 341, 448; 221/150 R; 312/298, 330 R

[56] References Cited

U.S. PATENT DOCUMENTS 2,563,208 8/1951 Bugenhagen ..... 62/378 X
3,271,973 9/1966 Amerio et al. ..... 62/378 X
3,699,780 10/1972 Gehrmann ..... 62/258 X
4,342,205 8/1982 Gram ..... 62/341
4,474,032 10/1984 Fenner ..... 62/341

*Primary Examiner*—Lloyd L. King
*Attorney, Agent, or Firm*—Cushman, Darby & Cushman

[57] ABSTRACT

A contact freezing apparatus comprises a plurality of freezing plates in which freezing medium is circulated in the interior, movably connected at a predetermined interval in an elevational direction, first elevation cylinder for raising the uppermost freezing plate until the respective plates are suspended and lowering the same so that the adjacent plates make contact with freezing pans, second elevation cylinder for raising or lowering at least one specific freezing plate in the state that respective plates are suspended to dispose the lowermost freezing plate at a predetermined position in height, and engaging or disengaging mechanism for engaging the specific plate with or from the second elevation cylinder in response to the position in height of the specific freezing plate. Thus, a worker can load or unload the freezing pan on or from the freezing plate at a predetermined position in height.

5 Claims, 11 Drawing Figures

11
18
18
16a
16
25
14
24
22
24
10
21
12a
20
16
25
14
12
12m

CONTACT FREEZING APPARATUS

BACKGROUND OF THE INVENTION

1. Field of the Invention

The present invention relates to a contact freezing apparatus which freezes sea food and, more particularly, to a contact freezing apparatus which can adjust the height of loading or unloading freezing pans (of loading fishes and shellfishes) on or from each freezing plate.

2. Description of the Prior Art

A lateral contact freezer is used to immediately freeze fishes and shellfishes collected in a fishing boat. A conventional lateral contact freezer includes, as shown in FIGS. 1 and 2, freezing plates 1 of multiple racks (11 effective racks in FIGS. 1 and 2), a set of two hydraulic cylinders 2 installed at both sides of the freezing plates 1 for elevationally moving the freezing plates 1 upwardly or downwardly and a number of freezing pans 3 placed on the respective freezing plates 1, and the entire freezer is disposed in a freezing room 4. Freezing medium such as Freon is circulated through the freezing plates 1 in the freezing room to aid the freezing action of the fishes and shellfishes placed on the freezing pans 3. The freezing plates 1 are sequentially connected at both sides via connecting rods 5 in suspended state. The uppermost freezing plate is fixedly secured through liners 7 to a mounting member 6 which is bridged fixedly over between the ends 2*a* of the rods of the two hydraulic cylinders 2 at right and left sides. The freezing plate 1 is elevationally moved upwardly or downwardly by telescoping the rods 2 in the respective cylinders 2 synchronously. When the rods 2 are extended at full stroke from the cylinders, all the freezing plates 1 are suspended as shown in FIG. 2. The interval between the freezing plates 1 is maintained in size capable of loading and unloading a lot of freezing pans by suitably selecting the extended length of the connecting rods 5. When the rods 2 are retracted into the hydraulic cylinders 2 in full stroke, the connecting rods 5 are idled, the freezing pans are intimately contacted between the freezing plates 1 in the sandwiched state on the freezing surfaces of the freezing plates 1 disposed above and below the freezing pans, thereby accelerating the freezing of the fishes and shellfishes laid on the freezing pans.

In such a conventional freezing apparatus, the works of loading or unloading the freezing pans in the accommodation space for the freezing pans formed between the adjacent freezing plates are carried out in the state as shown in FIG. 2. In this state, the lowermost freezing plate is disposed at the lower position which makes contact with the foundation of the freezing apparatus, while the uppermost freezing plate is disposed in height of the degree at which a worker can handle the freezing pans in standing in the vicinity, and the heights of the respective freezing plates of the stages are different when the worker loads and unloads the freezing pans on and from the plates. Thus, when the worker loads or unloads the freezing pans on or from the position higher or lower than the waist of the worker, he should bend and straighten the body. When the worker loads or unloads the freezing pans on or from the freezing plate lower than the waist, he readily suffers from a pain in the waist due to the bending and straightening of his waist. Further, since the loading and unloading room (i.e., freezing room) surrounded by the contact freezer is normally maintained at low temperature lower than 0° C. to −10° C. in high moisture, it is further severe in environment for the worker who loads and unloads the freezing pans, thereby causing the worker to decrease the working efficiency.

SUMMARY OF THE INVENTION

It is, therefore, an object of the present invention to provide a contact freezing apparatus in which the loading and unloading works of a lot of freezing pans on and from freezing plates can be carried out at the position of the desired height.

Another object of the present invention is to provide a contact freezing apparatus in which a worker can load and unload a number of freezing pans on and from all freezing plates held at the position of height in the vicinity of his waist or breast.

The above and other objects of the invention will be apparent by those skilled in the art from a reading of the following detailed description of the disclosure found in the accompanying drawings and novelty thereof pointed out in the appended claims.

BRIEF DESCRIPTION OF THE DRAWINGS

FIGS. 1 and 2 are views showing the construction of a conventional contact freezing apparatus, in which FIG. 1 shows a schematic front view illustrating the state that freezing plates are lowered, while FIG. 2 shows a schematic front view illustrating the state that freezing plates are raised.

FIG. 3 is a schematic front view showing the state that freezing plates are lowered;

FIG. 4 is a view showing the connecting relationship between the freezing plates;

FIG. 5 is a partly omitted schematic perspective view;

FIG. 6 is a detailed view of the engaging and disengaging mechanism;

FIG. 7 is a plan view of the engaging and disengaging mechanism;

FIG. 8 is an explanatory view of the operation of the engaging and disengaging mechanism;

FIGS. 9 to 11 are explanatory views of the work for unloading many freezing pans from the freezing plate; and FIGS. 9 and 10 are views partly omitted.

DETAILED DESCRIPTION OF THE PREFERRED EMBODIMENTS

An embodiment of the present invention will now be described in more detail with reference to the accompanying drawings.

Figure 1:
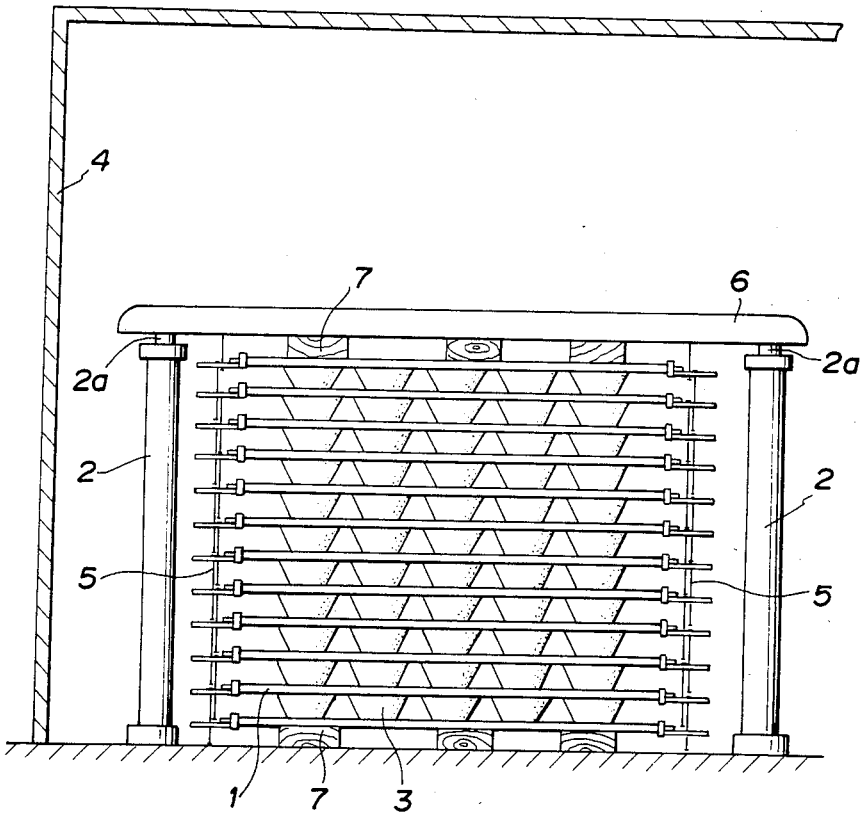
Figure 2:
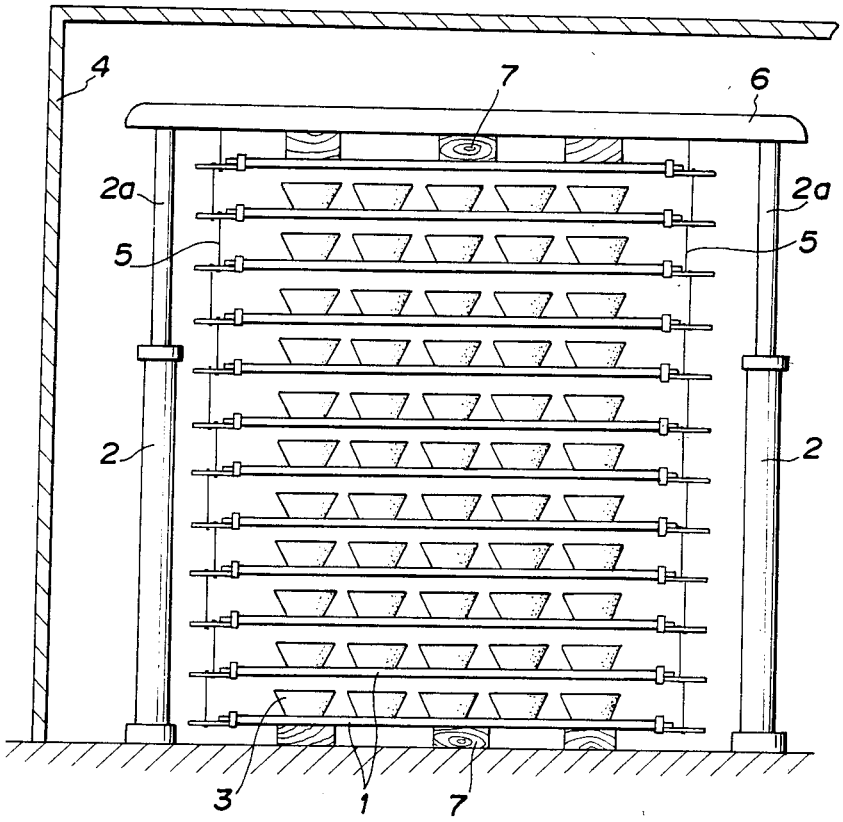
Figure 3:
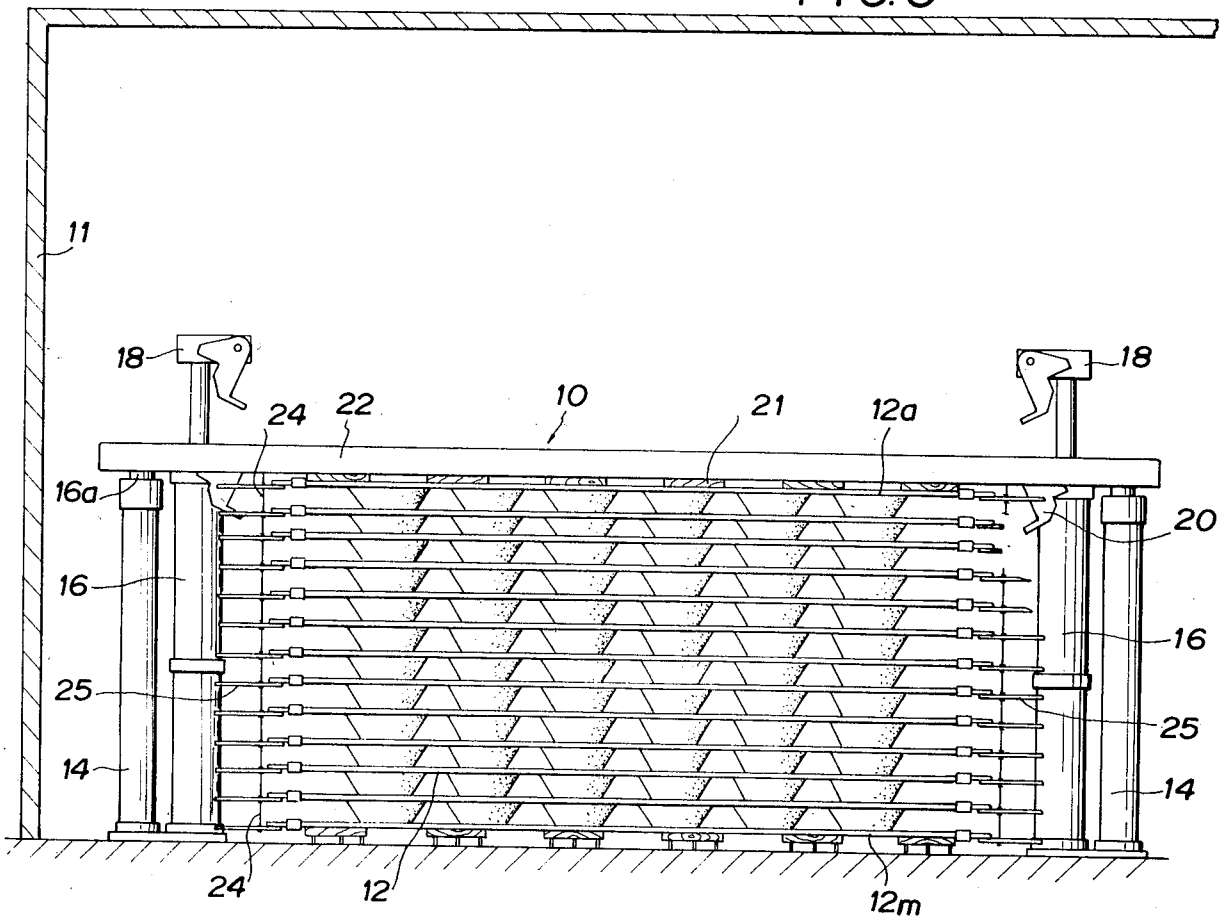
FIGS. 3 through 11 are views showing an embodiment of a contact freezing apparatus constructed according to the present invention, exemplifying the structure of a contact freezer for a fishing boat.

In FIG. 3, the entire structure of a contact freezing apparatus according to the present invention is schematically designated by reference numeral 10. This overall contact freezer comprises a plurality of, effective twelve (actually thirteen) freezing plates 12 which are disposed in a freezing room 11 of a fishing boat, hydraulic cylinders 14 disposed at both sides of the freezing plates 12 for elevationally moving the freezing plates 12 upwardly or downwardly, 2-stage hydraulic cylinder 16 disposed inside the hydraulic cylinders 14 for altering the position in height of the freezing plates, a first engaging and disengaging mechanism 18 for engaging and disengaging the first rod 16*a* of the hydraulic cylinder 16 with and from a specific freezing plate 12 and a second engaging and disengaging mechanism 20 for engaging and disengaging the second rod 16*b* of the hydraulic cylinder 16 with and from other specified freezing plate 12.

Figure 4:
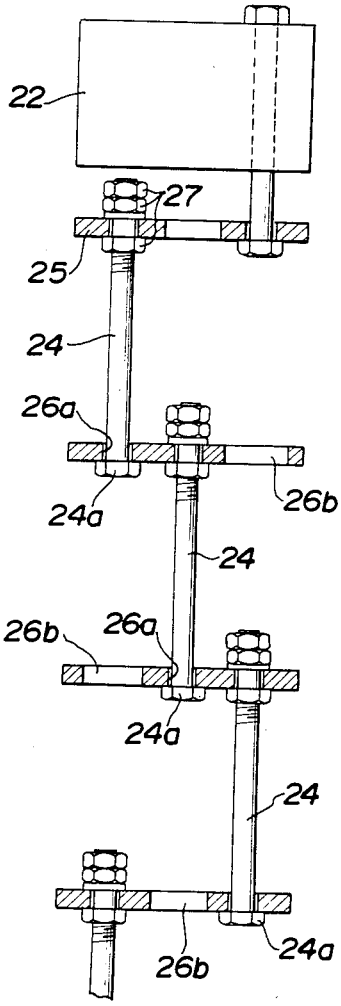

The uppermost one of the freezing plates 12 is fixedly secured to an elevation member 22 which is bridged over the ends of the rods of the hydraulic cylinders 14 through liners 21 formed of synthetic resin and fixedly secured at both ends to the end of the rods. The uppermost freezing plate 12*a* and the freezing plates 12*b*, 12*c*, . . . , 12*m* disposed lower than the uppermost freezing plate 12*a* are respectively connected by connecting rods 24 between the adjacent freezing plates. As shown in FIGS. 3 and 4, connecting plates 25 are horizontally protruded and arranged at both sides of the respective freezing plates 12, and the connecting rods 24 are respectively vertically extended through holes 26*a* perforated at the connecting plates 25. The connecting plates 25 are fixedly secured by two to the sides of the respective freezing plates 11 in space at both sides of the freezing plates 11. The upper end portion of each connecting rod 24 is threaded, and nut members 27 which make contact with both upper and lower surfaces of each connecting plate 25 are engaged with the threaded upper end portion of the connecting rod 24. Then, the other end of the connecting rod 24 which is extended through a hole 26*a* perforated at the connecting plate 25 disposed at the position lower by one stage than the previous connecting plate 25 is formed at a head 24*a* which is larger in diameter than the diameter of the hole 26*a*. Thus, one end of each connecting rod 24 is fixedly secured to one connecting plate 25, and the other end is formed at the head which makes contact with the lower surface of the connecting plate 25 disposed at the position lower by one stage than the previous connecting plate 25 in such a manner that the connecting plate 25 disposed at the position lower by one stage can move vertically with respect to the connecting plate 25, to which the connecting rod 24 is fixedly secured. Another hole 26*b* of the size which passes the head formed at the lower end of the connecting rod 24 is formed at the connecting plate 25 disposed at the position lower by two stage than the connecting plate 25 which is fixedly secured with the connecting rod 24. This hole 26*b* serves to smoothly rise the freezing plate without contacting the connecting plate disposed at the position lower by one stage with the head of the connecting rod 24 when each freezing plate is sequentially raised from the lower freezing plate disposed at the position lower than the previous freezing plate by the cylinders and the engaging and disengaging mechanism as will be described in greater detail. The respective connecting rods 24 which connect between the adjacent freezing plates 11 are arranged at the displaced position as shown in FIG. 4. In this embodiment, a support which is supported by the engaging and disengaging mechanism 18 and 20 is horizontally protruded from the uppermost freezing plate to the connecting plates of the fifth and tenth freezing plates 12*e* and 12*j* as will be described in greater detail.

Figure 5:
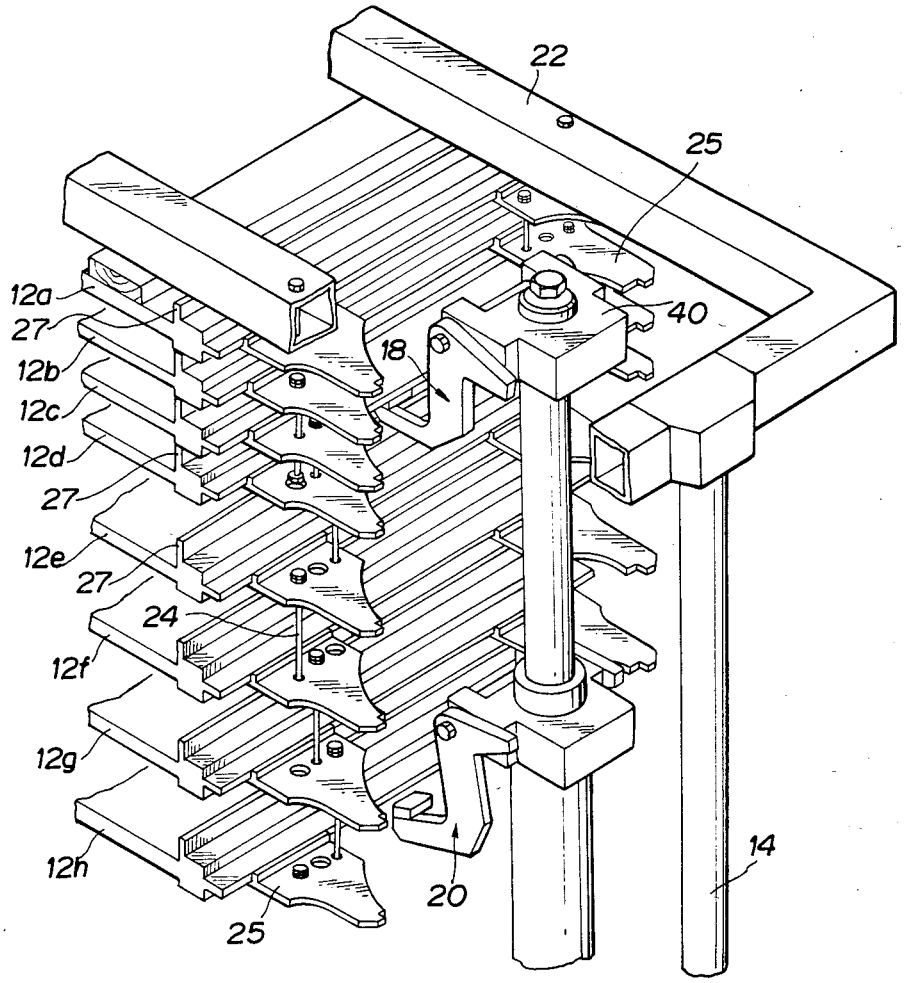
Figure 6:
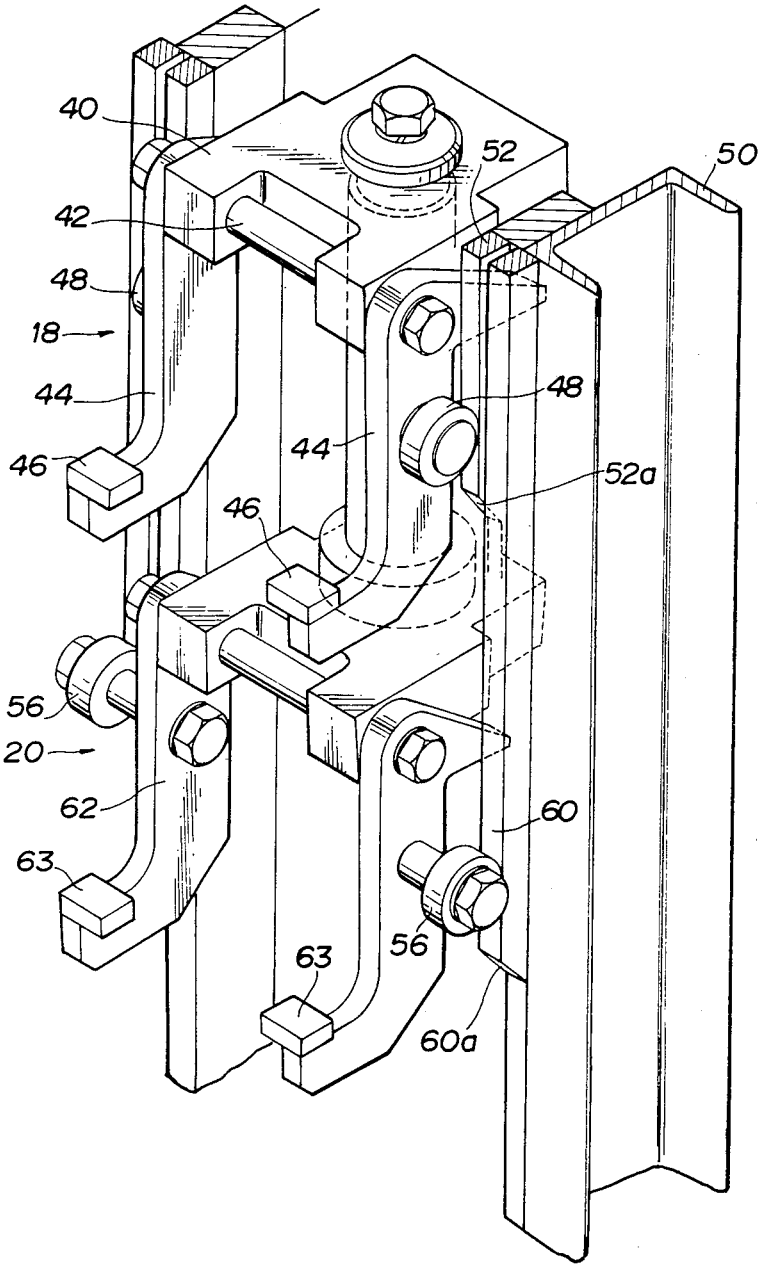
Figure 7:
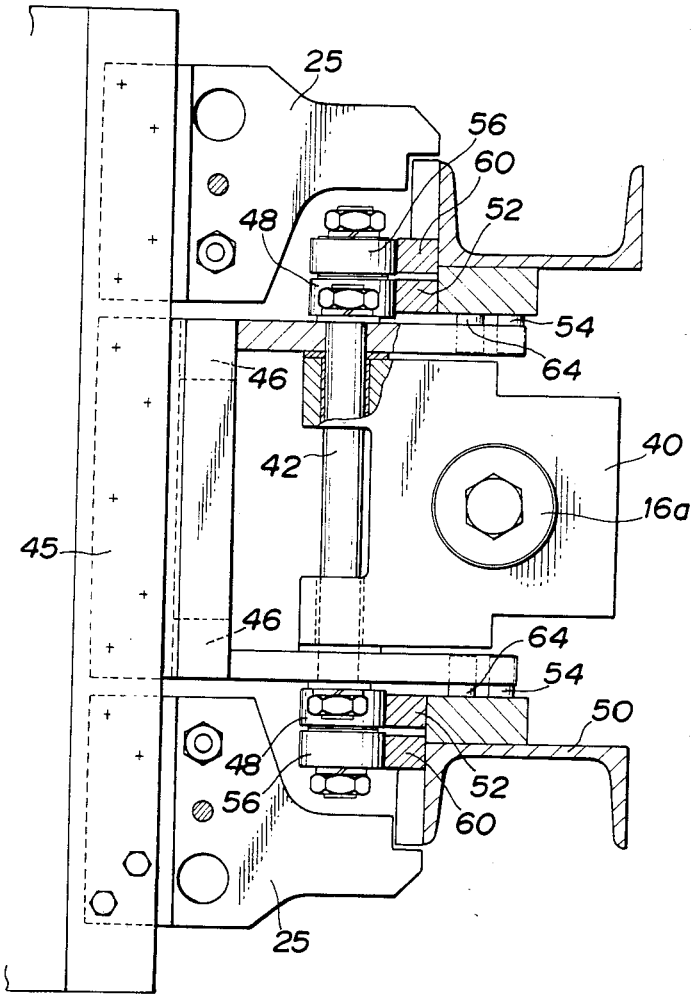

Further, spacers 27 are respectively arranged which extend vertically from the upper surfaces of the respective freezing plates 11 at both sides as shown in FIG. 5. Each spacer 27 is disposed at the position inside the connecting plate 25 to inhibit to contact between the cooling surfaces of the freezing plates which are disposed adjacent between upper and lower positions when the freezing plates are sequentially raised by the cylinders and the engaging and disengaging mechanisms.

Each freezing plate 12 is formed of a corrosion resistant aluminum material, freezing medium inlet and outlet holes are respectively mounted at the ends of each freezing plate 12, and the outlet hole of the uppermost freezing plate 12*a* is connected by a rubber pipe to the inlet hole of the freezing plate 12*b* disposed at the position lower by one stage therefrom. Similarly, the outlet hole of the freezing plate 12*b* is connected to the inlet hole of the freezing plate 12*c* disposed at the position lower by one stage therefrom, and the outlet hole of the freezing plate 12*c* is connected by a rubber pipe to the inlet hole of the freezing plate 12*d* disposed at the position lower by one stage therefrom. In this manner, the uppermost freezing plate to the fourth freezing plate from the uppermost freezing plate are respectively connected by the rubber pipes, the inlet side of the uppermost freezing plate 12*a* is connected to a freezing medium reservoir (not shown) through a freezing medium flow rate control valve (not shown), and the outlet side of the fourth freezing plate 12*d* from the uppermost freezing plate 12*a* is connected to a compressor (not shown). Thus, four freezing plates are connected in series with each other to form a freezing circuit, and Freon 22 is used as freezing medium. More particularly, one freezing circuit is formed from the fifth freezing plate 12*e* from above to the eighth freezing plate 12*h* from above, and another one freezing circuit is formed from the ninth freezing plate 12*i* from above to the lowermost freezing plate 12(*l*).

In this manner, Freon 22 which is flowed from the inlet hole is circulated therein through the respective freezing plates, and exhausted from the outlet hole, thereby forming a cooler on the upper and lower surfaces of the respective freezing plates. A number of freezing pans 11 laid with fishes and shellfishes are contained between the adjacent freezing plates, and the upper and lower freezing plates disposed above and below the freezing pans are contacted directly with the freezing pans in sandwich state to freeze the fishes and shellfishes as will be described in greater detail.

Figure 9:
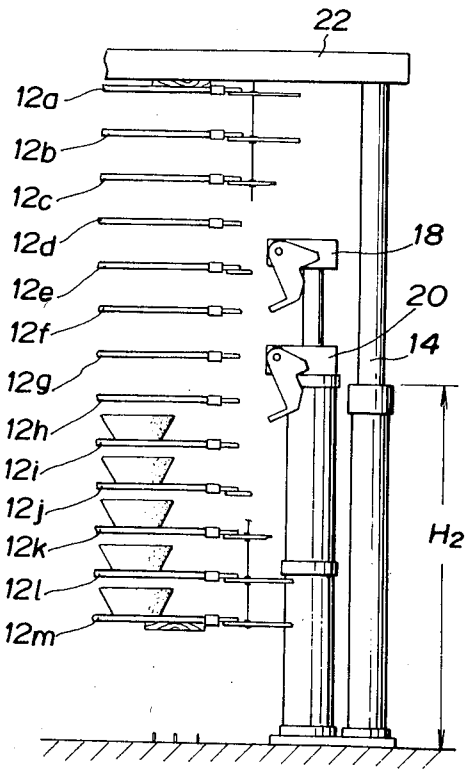

The freezing plates of effective twelve stages thus constructed as described above can be elevationally moved upwardly or downwardly by the hydraulic cylinders 14, and when the cylinders are extended at the rods in full stroke, the respective freezing plates are suspended through the connecting rods as shown in FIG. 9. When the cylinders 14 are retracted at the rods in full stroke, the lowermost freezing plate 12*m* makes contact with the installing surface of the freezing apparatus through a liner 32 formed of synthetic resin as shown in FIG. 3, the freezing pans to be placed on the freezing plate 12*m* makes at the top contact with the lower surface of the freezing plate 12(*l*) disposed at the position upper by one stage. Similarly, the adjacent freezing plates make direct contact with the freezing pans 11 contained between the adjacent freezing plates in sandwich state. Fishes and shellfishes which are laid on the freezing pans 11 are frozen in this state.

A pair of 2-stage hydraulic cylinders 16 are disposed inside the hydraulic cylinders 14. These hydraulic cylinders 16 operate when the hydraulic cylinders 14 are disposed in the fully extended state. All the freezing plates connected to the specific freezing plate are raised or lowered by raising or lowering the specific freezing plate, thereby disposing the freezing plates disposed at the position lower or higher than the waist of the worker to the desired position in cooperation with the engaging and disengaging mechanisms 18 and 20 fixedly secured to the hydraulic cylinders 16. This operation will be further described in more detail.

Figure 8:
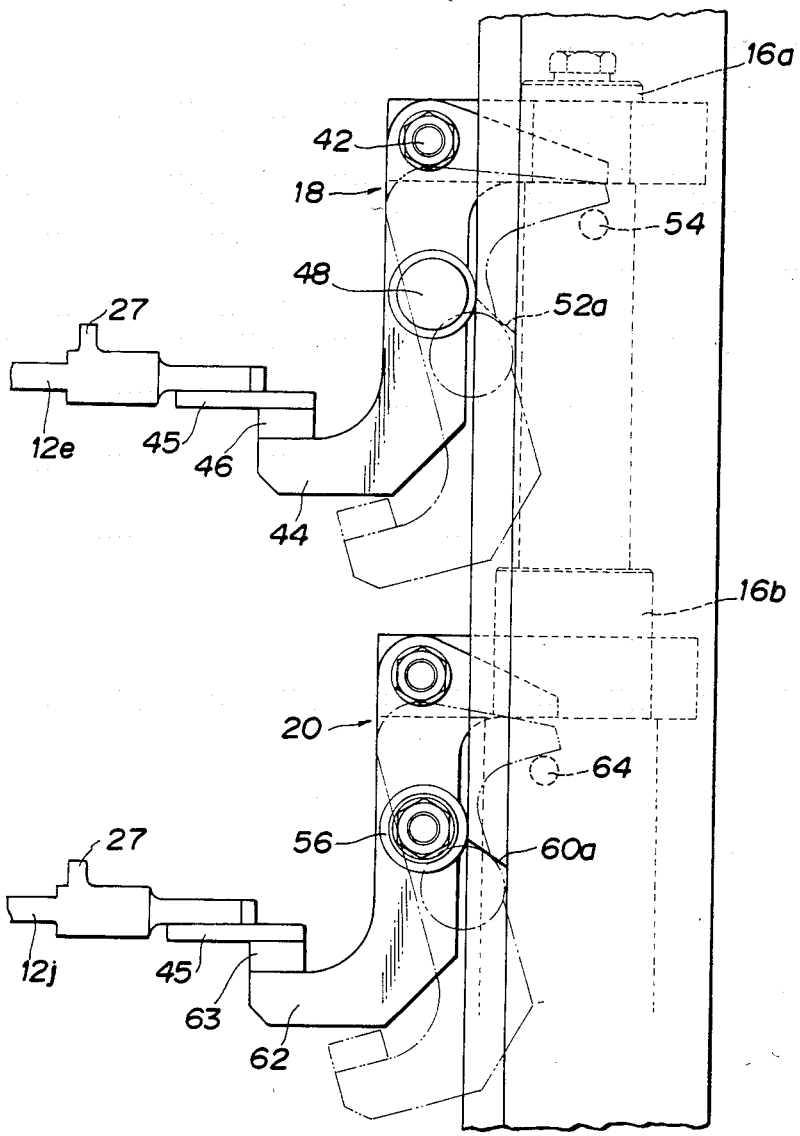

The first and second engaging and disengaging mechanism 18 and 20 are respectively fixedly secured to the ends of the first and second rods 16*a* and 16*b* of the hydraulic cylinders 16. A mounting body 40 of the first engaging and disengaging mechanism 18 is fixedly secured to the end of the first rod 16*a*. A shaft 42 is fixedly secured at both ends between the both sides of the mounting body 40, and a pair of arm members 44 are arranged so as to rotate around the shaft 42. Freezing plate supports 46 are respectively formed at one ends of the pair of arm members 44, and the supports 46 are engaged with the lower portion of a supporting plate 45 which is fixedly secured to the end of the fifth freezing plate 12*e* from the uppermost freezing plate. Further, a guide roller 48 is rotatably mounted on the arm member to roll on a guide passage 52 formed on a guide frame 50. The guide passage 52 is formed linearly along the direction that the rod of the hydraulic cylinder 16 telescopes in the guide passage 52, and the oblique portion 52*a* is formed at the position substantially corresponding to the position of the freezing plate 12*e* in the state that the entire freezing plate is suspended, i.e., the cylinder 14 is extended at the rod in full stroke. The bottom of the oblique portion 52*a* corresponds to the bottom dead point of the first rod 16*a*. Further, when the roller 48 is disposed at the portion terminated at the linear portion of the guide passage 52, a pair of pins 54 are arranged on the guide frame 50 so as to make contact with the lower surface of the end of the side opposite to the end of the freezing plate support of the pair of arm members 44. When the roller 48 moves downwardly on the linear portion of the guide passage 52 so that the linear portion is moved to the position terminated at the linear portion, one end of the arm member 44 makes contact with the pin 54, the arm member 44 is thereby rotated around the shaft 42, and the freezing plate support 46 disposed at the other end of the arm member 44 is separated from the supporting plate 45 of the freezing plate 12*e* as shown in FIG. 8.

The second engaging and disengaging mechanism 20 is constructed similarly to the first engaging and disengaging mechanism 18, but the second engaging and disengaging mechanism 20 is constructed to be engaged with and disengaged from the tenth freezing plate 12*j* from the uppermost freezing plate. The guide passage 60, on which the roller 50 of the second engaging and disengaging mechanism 20 rolls, is formed on the guide frame 50 formed with the guide passage 52, on which the roller 48 of the first engaging and disengaging mechanisms 18 rolls. An oblique portion 60*a* is formed on the position corresponding to the freezing plate 12*j* disposed at the tenth position from the uppermost freezing plate 12*a* when the first rod 16 is extended at the rod in full stroke. The bottom of the oblique portion corresponds to the bottom dead point of the second rod 17*b*. A pair of pins 64 are arranged on the guide frame so as to make contact with the lower surface of the end opposite to the end formed with the freezing plate support 63 of the pair of arm members 62 when the roller 56 is disposed at the portion of the guide passage 60 terminated at the linear portion of the guide passage 60.

These engaging and disengaging mechanism 18 and 20 are respectively engaged with the freezing plates 12*e* and 12*i* when the first and second rods 16*a* and 16*b* of the hydraulic cylinders 16 are extended from the bottom dead points, and are composed to be disengaged form the freezing plates when they are again arrived at the bottom dead point after they are further extended in full stroke.

Then, the case when a worker in a fishing boat loads and unloads the freezing pans on and from the respective freezing plates by the contact freezing apparatus of the present invention will now be described.

In this embodiment, the effective operating height $H_1$ of the freezing plates is set approx. 2400 mm from the reference level L, at which the freezing apparatus is installed. An interval S between the freezing plates at this time is set to 130 mm. The loading and unloading level height $H_2$ is set 1200 mm from the reference level L so that a worker can load and unload all the freezing pans in the height near the waist or breast of the worker.

The hydraulic cylinders 14 and the 2-stage hydraulic cylinders 16 for elevationally moving the freezing plates upwardly or downwardly are set in size as follows:

| | | Full length at retraction | Stroke | Full length at extension |
|---|---|---|---|---|
| Hydraulic cylinder 14 | | 1236 (mm) | 980 (mm) | 2216 (mm) |
| Hyd. cyl. 16 | 1st rod 16a | 1588 | 368 | 1956 |
| | 2nd rod 16b | 1196 | 460 | 1656 |

The case that the freezing pans are unloaded from each freezing plate will now be described. As shown in FIG. 3 in the state that the freezing pans are contained in each freezing plate, all the hydraulic cylinders are retracted, each of freezing pans is interposed in sandwich state by the freezing plates disposed at the upper and lower positions in direct contact with the cooling surfaces of the freezing plates. The hydraulic cylinders 14 are slowly extended from this state (which will be termed "first stroke"). When the hydraulic cylinders 14 are extended in full stroke (FIG. 9), all the freezing plates are suspended. The freezing plates disposed at the position higher than the loading level $H_2$ when the first stroke is finished are five freezing plates 12*a*, 12*b*, 12*c*, 12*d*, 12*e*, 12*f* and 12*g*. This means that the freezing pans can be unloaded at the loading level $H_2$ in the first stroke from the uppermost freezing plate to the seventh freezing plate. The hydraulic cylinders 14 are slowly extended in such a manner that six freezing pans laid on on freezing plate can be preferably unloaded at the extending speed to be able to unload the freezing pans in height near the unloading level $H_2$ in adequate margin.

Subsequently, the first rods 16*a* of the 2-stage hydraulic cylinders 16 are extended (which will be termed "second stroke"). The roller 48 of the first engaging and disengaging mechanism 18 fixedly secured to the end of the first rod 16*a* is rolled to the oblique portion 52*a* of the guide rail 52, and moves upwardly while rolling on the linear portion of the rail extending vertically. A pair of arm members 44 are rotated around the shaft 42 at this time, the freezing plate support 46 formed at one end is engaged with the lower portion of the supporting plate 45 of the fifth freezing plate 12*e* from the uppermost freezing plate. As the first rod 16*a* extends, eight freezing plates disposed at the position lower than the freezing plate 12*e* is raised in the suspended state. The freezing plate disposed above the freezing plate 12*e* at this time is sequentially raised from the freezing plate 12*d*.

Figure 10:
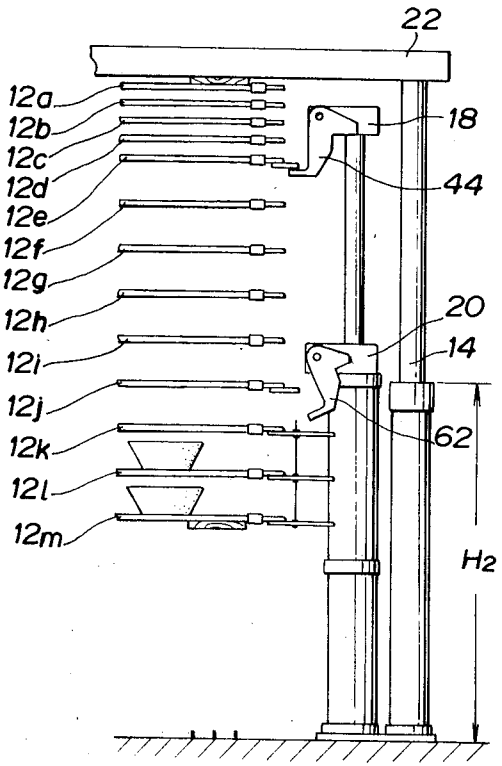

When the first rod 16*a* is extended in full stroke (in FIG. 10), ten freezing plates 12*a* to 12*j* are disposed at the position higher than the unloading level $H_2$. This means that the freezing pans can be unloaded newly at the unloading level $H_2$ in the second stroke from the three freezing plates 12*h*, 12*i* and 12*j*.

The extending speed of the first rod 14*a* can be similarly set to the that of the hydraulic cylinder 12 in the first stroke.

Figure 11:
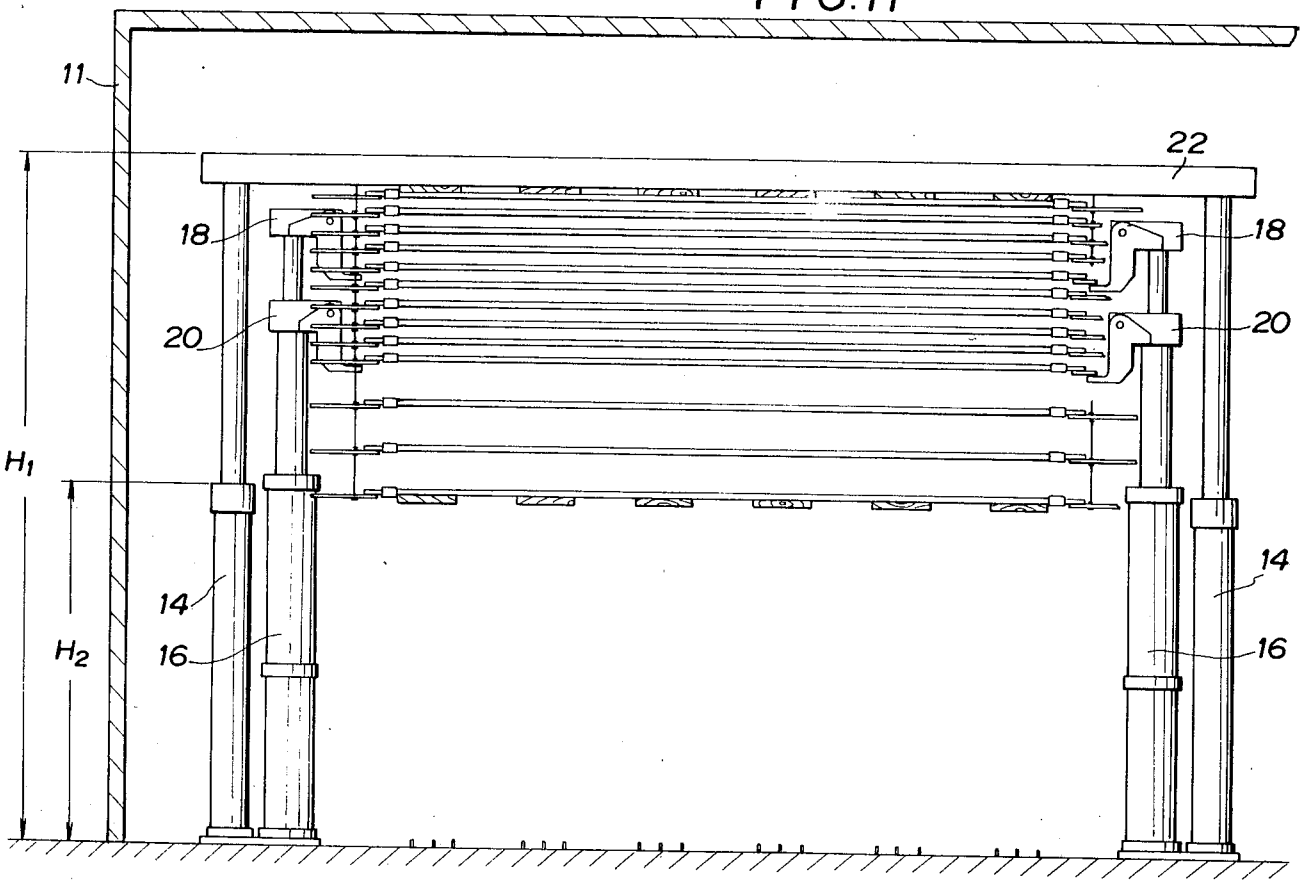

After the first rod 16*a* is extended in full stroke, the second rod 16*b* is extended (which will be termed "third stroke"). The roller 56 of the second engaging and disengaging mechanism 20 fixedly secured to the second rod 16*b* rolls on the guide passage 60 similarly to the roller 48 of the first engaging and disengaging mechanism 18, a pair of arm members 62 are rotated around a shaft 63, and the support 63 of the arm member 62 is engaged with the lower portion of the support 45 of the freezing plate 12*j*. As the second rod 16*b* is extended, three freezing plates 12, 12(*l*), 12*m* disposed at the position lower than the freezing plate 12*j* are raised in the suspended state. These three freezing plates are all disposed at the position higher than the unloading level $H_2$ in the state that the second rod 16*b* is extended in full stroke (in FIG. 11). In other words, the freezing pans can be unloaded at the unloading level $H_1$ from these freezing plates.

Therefore, the works for unloading the freezing pans on the respective freezing plates can be sequentially carried out in the first, second and third strokes at the unloading level $H_2$. Thus, it is not necessary for the worker to extremely bend his waist, thereby alleviating his fatigue.

When the respective freezing plates reaches the unloading level $H_2$ in the above-described first, second and third strokes, a limit switch is arranged to operate to stop the extension of each cylinder. The worker can unload the freezing pans on the freezing plate during the stopping period while it reaches the unloading level $H_2$, other switch is operated after the freezing pans is unloaded completely, and the cylinders can be again extended.

Then, when a lot of freezing pans laid with fishes and shellfishes are contained on the respective freezing plates, the worker can carry out the above-described operation in reverse sequence in the respective strokes. In other words, it will be understood from the foregoing description that many freezing pans can be contained on the respective freezing plates at the loading level $H_2$ in the same manner as the unloading case.

The embodiment described above is applied to the contact freezer for a fishing boat according to the present invention. However, the present invention may also be applied to a contact freezer except the above freezer. Further, in the embodiments described above, 2-stage hydraulic cylinders are employed as means for elevationally moving the specific freezing plate. However, the present invention is not limited to such hydraulic means, but may be achieved by other means similar to the above.

What is claimed is:

1. A contact freezing apparatus for a freezing room comprising:

a plurality of generally horizontal freezing plates in stacked arrangement, in which freezing medium is circulated to form upper and lower cooling surfaces, adjacent plates having lost-motion connection at a predetermined vertical interval, said plates being adapted to have freezing pans containing articles to be frozen supported on their upper surfaces;

first elevating-and-lowering means for elevating an uppermost plate until each plate therebelow is suspended from the plate immediately thereabove and then lowering said uppermost plate until each plate above the lowermost makes contact with the pan supported on the plate immediately therebelow;

second elevating-and-lowering means for elevating at least one specific plate from a position wherein all said plates below the uppermost are suspended to a position wherein said lowermost plate is located at a predetermined position in height, and then lowering the specific plate to its suspended position; and means for engaging said specific plate with said second means upon elevating movement thereof, and then disengaging said specific plate from said second means upon completion of lowering movement thereof, said engaging and-disengaging means comprising, arm means movable mounted on said second means and having at one end thereof supporting members for supporting the specific plate, said arm means being adapted to move said members into supporting engagement with the specific plate on elevating movement of said second means, and then to move said members into disengagement with the specific plate on completion of lowering movement of said second means.

2. Contact freezing apparatus according to claim 1, wherein the arm means is rotatably mounted to the second means, a roller is provided on said arm means between its center of rotation and the supporting members, said roller being adapted to be moved on a guide frame having a first guiding surface extending in the direction of movement of the second means and a second guiding surface extending downward from said first guiding surface, the lowermost end of said second guiding surface corresponding to a bottom dead point of said second means, said arm means being rotated to move the members into supporting engagement upon upward and downward movement of said roller along said second guiding surface, and being rotated to move the members into disengagement upon downward movement of said roller along said second guiding surface.

3. Contact freezing apparatus according to claim 2, wherein other end of said arm means is adapted to be engaged with a pin provided on said guide frame, during upward and downward movement of the roller on said second guiding surface.

4. Contact freezing apparatus for a freezing room comprising:

a plurality of generally horizontal freezing plates in stacked arrangement, in which freezing redium is circulated to form upper and lower cooling surfaces, adjacent plates having lost motion connection at a predetermined vertical interval, said plates being adapted to support freezing pans containing articles to be frozen on their upper surfaces;

first elevating-and-lowering means for elevating an uppermost freezing plate until each plate therebelow is suspended from the plate immediately thereabove and then lowering the uppermost plate until each plate above the lowermost contacts with the pan supported on the plate immediately therebelow;

second elevating-and-lowering means for elevating one freezing plate from a position wherein all said plates below the uppermost are suspended to a position wherein said lowermost plate is located at first predetermined position in height, and then lowering said one plate to its suspended position;

first means for engaging said one plate with said second elevating-and-lowering means upon elevation movement thereof, and then disengaging said one plate from said second elevating-and-lowering means upon completion of lowering movement thereof;

third elevating-and-lowering means for elevating another plate below said one plate after said second elevating-and-lowering means completes its elevating movement, so that said lowermost plate is located at a second predetermined position in height, and then lowering the one plate to its initial suspended position; and second means for engaging said another plate with said third elevating-and-lowering means, and then disengaging said another plate from said third elevating-and-lowering means upon completion of lowering movement thereof;

said first engaging-and-disengaging means comprising first arm means rotatdbly mounted on said second elevating-and-lowering means and having at one end thereof first supporting members for supporting the one plate, said first arm means being adapted to rotate in one direction upon elevating movement of said second elevating-and-lowering means to move said first supporting members into supporting engagement with said one plate, and then to rotate in other direction upon completion of lowering movement of said second elevating-and-lowering means to move said first members out of supporting engagement with said one plate, said second engaging-and-disengaging means comprising second arm means rotatably mounted on said third elevating-and-lowering means and having at one end thereof second supporting members for supporting the another plate, said second arm means being adapted to rotate in one direction, the same as that of said first arm means, upon elevating movement of said third elevating-and-lowering means to move said second members into supporting engagement with the another plate, and then to rotate in the other direction, the same as that of said first arm means, to move said second members out of supporting engagement with said another plate upon completion of lowering movement of said third elevating-and-lowering means.

5. Contact freezing apparatus according to claim 4, wherein:

said first and second arm means have first and second rollers between their corresponding centers of rotation and their corresponding supporting members, said first and second rollers being adapted to move on a guide frame having a first guiding surface and second and third downward extending guiding surfaces, the lowermost ends of said second and third surfaces corresponding to bottom dead points of said second and third elevating-and-lowering means, respectively, said first and second arm means being rotated in said one direction upon upward movement of said first and second rollers along said second and third guiding surfaces, respectively, to move said first and second members into supporting engagement with the one and another plates respectively during upward and downward movements of said first and second rollers along said first guiding surface, respectively, and being rotated in said other direction on downward movements of said first and second rollers on said second and third guiding surfaces, respectively.

* * * * *